United States Patent [19]

Fernandez

[11] Patent Number: 4,458,386

[45] Date of Patent: Jul. 10, 1984

[54] PAPER FASTENER

[76] Inventor: Armando M. Fernandez, 1800 Belmont La., Redondo Beach, Calif. 90278

[21] Appl. No.: 429,978

[22] Filed: Sep. 30, 1982

Related U.S. Application Data

[63] Continuation of Ser. No. 113,807, Sep. 30, 1982, abandoned.

[51] Int. Cl.[3] ..... B42F 1/02

[52] U.S. Cl. ..... 24/67.9; 24/67 R; 24/545; 24/546

[58] Field of Search ..... 24/67.9, 67.3, 67.5, 24/547, 551, 552, 553, 554, 524, 527, 555, 556

[56] References Cited

U.S. PATENT DOCUMENTS

| | | | |
|---|---|---|---|
| 742,892 | 11/1903 | McGill | 24/261 R |
| 761,631 | 5/1904 | Gorton | 24/261 R |
| 761,635 | 5/1904 | Kelley | 24/261 R |
| 1,167,734 | 1/1916 | Anderson | 24/261 R |
| 1,948,053 | 2/1934 | Spindler | 24/261 R |
| 2,218,438 | 10/1940 | Robinson | 40/11 A |
| 2,765,926 | 10/1956 | Lee et al. | 24/261 R |
| 3,724,036 | 4/1973 | Botsford | 24/261 R |
| 4,055,874 | 11/1977 | Brown | 24/67.9 |

FOREIGN PATENT DOCUMENTS

| | | | |
|---|---|---|---|
| 1293325 | 10/1972 | United Kingdom | 24/67.9 |

*Primary Examiner*—Victor N. Sakran

[57] ABSTRACT

A sheet fastener made of resilient stock comprising a finger tab to facilitate mounting on a thick as well as a thin sheet pile. Reversible for restoring the holding forces by mounting the fastener from the opposite side. Comprising two elements extending from a common base, one element loops around the other element, said other element comprises said finger tab, both sections laying on the same plane when said fastener is in a resting position.

4 Claims, 5 Drawing Figures

PAPER FASTENER

This is a continuation application of applicant's copending application Ser. No. 06/113,807, filed Sept. 30, 1982, now abandoned.

BACKGROUND OF THE INVENTION

1. Field of the Invention

This invention relates in general to a fastener for holding a plurality of objects. More specifically, an improved method for holding a plurality of objects.

2. Description of the prior art

Paper fasteners take several forms. The most common is the kind formed with three U-shaped bends with the first nested between the legs of the third. This form of fastener is satisfactory for holding together a few thin sheets. However, when used upon a thick pile the angle between the two parallel legs is such that the legs twist scratching the paper, slipping off the paper pile and causing excess bulk when filed. Another common kind is the one having a torsion bar or an intermediate portion reversly bent upon itself from which two sections extend overlapping each other. This type eliminates most of the above mentioned problems but generates another problem, these fasteners lose the capacity of holding thin piles of paper after mounting on a thick paper pile. This is due to the loss of tension between the two arms. Other fasteners have been designed with the purpose in mind of reducing slippage when the fastener is used on a thick pile. These fasteners also have drawbacks. Some are difficult or expensive to manufacture. Others do not consider the advantage of having a torsion bar. and yet others require too much effort to mount on thick paper piles.

SUMMARY OF THE INVENTION

It is accordingly a general object of this invention to provide a paper fastener which overcomes the afformentioned disadvantages of prior fasteners.

A more specific object of this invention is to provide a fastener that is easily mounted on a thin sheet pile as well as a substantially thick sheet pile.

Another object of this invention is to provide a fastener that securely holds a thin sheet pile after being stretched by attaching to a substantially thick sheet pile.

Another object of this invention is to provide a fastener that bears flat against the sides as well as the edge of a sheet pile and the like reducing excessive bulk when various piles are stacked.

Another object of this invention is to provide a fastener that secures firmly to the objects held and yet will be easily removed without damaging the sheets.

Yet additional objects of this invention is to provide a fastener of the afornoted character and which is simple and economical to manufacture.

BREIF DESCRIPTION OF THE DRAWINGS

The features of the invention which are believed to be new are set forth with particularity in the appended claims. The invention, althought not limited to the two configurations shown in the drawings, together with further objects and advantages thereof, may best be understood, however, by reference to the following description taken in conjuction with the accompanying drawings, in which:

DESCRIPTION OF THE PREFERRED EMBODIMENTS

Figure 1:
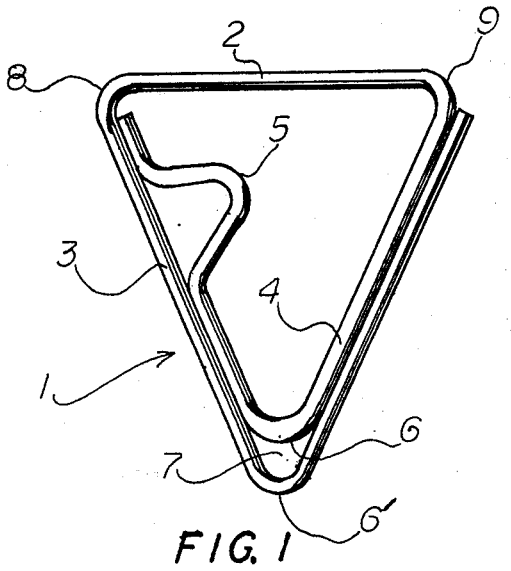
FIG. 1 is a front elevational view of a wire fastener according to the invention.

These and other features will become more apparent from the following description taken in conjunction with the drawings wherein:

One embodiment according to the present invention is illustrated in FIG. 1, generally comprising a single continuous lenth of wire 1 which is formed with torsion bar 2 from which bends 8 and 9 extend to form a looping element 3 and inner element 4. Inner element 4 is shaped to form a tab 5 and is shorter than looping element 3 to provide a mounting lip 7.

Figure 2:
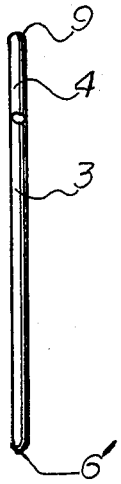
FIG. 2 is a side elevational view of the fasteners shown in FIG.'s 1 and 3.
Figure 4:
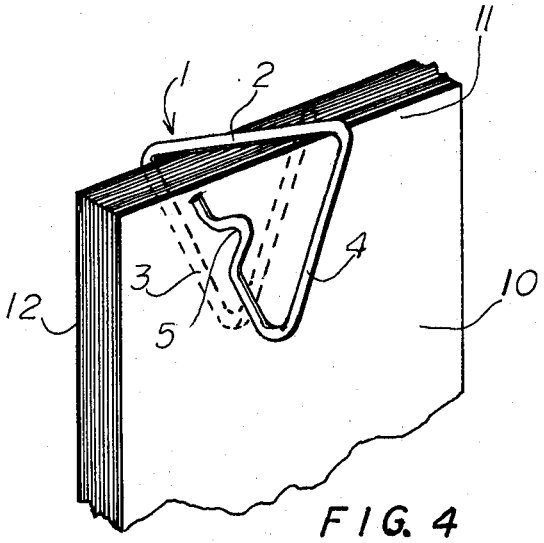
FIG. 4 is a perspective view showing the fastener of FIG. 1 in use.
Figure 5:
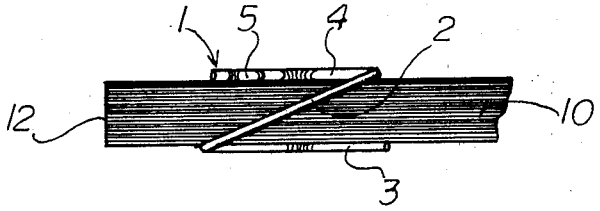
FIG. 5 is a side elevation of the view shown in FIG. 4.

Torsion bar 2, preferably shorter than the perpendicular distance from torsion bar 2 to curvature 6' of looping element 3. more over, fastener 1 is formed such that all its elements lay on the same plane, as shown in FIG. 2.

Tab 5, preferably formed by bending other element 4 into a loop, as shown in FIG. 1.

Fastener 1 is preferably formed of a low carbon steel covered with a rust resistant coating to prevent paper pile 10 from staining due to rust. Coating can be color coded for identifying different paper piles that have been filed.

In use, fastener 1 is disposed upon a paper pile or the like as illustrated in FIGS.'s 4 and 5. Entry of the papers to be held into fastener 1 is achieved by placing lip 7 on edge 11 of one side of the paper pile 10, then, spreading elements 3 and 4 by depressing tab 5. When fastener 1 is in place, both elements 3 and 4 and torsion bar 2 lay flat against the sides and edge 12 of paper pile 10, as shown in FIG.'s 4 and 5.

Figure 3:
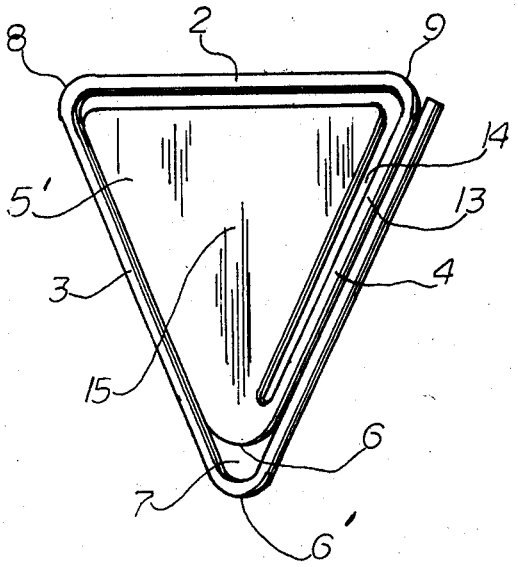
FIG. 3 is a front elevational view of an alternative embodiment of the present invention.

An alternative form of the present invention is that illustrated in FIG. 3. As before, both elements 3 and 4 are formed in the same manner as previously described except tab 5' is formed to cover entire area 15 confined within the perimeter of looping element 4. Tab 5' is detached from portion 13 of looping element 4 by means of slot 14 which causes torsional forces on portion 13 to be distributed over a greater length. Entry of the papers to be held into the latter fastener is achieved as previously described.

While particular embodiments of the present invention have been shown and described, it will be obvious to those skilled in the art that changes and modifications may be made without departing from the invention in its broader aspects. Accordingly, the aim in the appended claims is to cover all such changes and modifications as fall within the true spirit and gist of the invention.

What is claimed is:

1. A fastener made of resilient stock which is easily mounted on a thin as well as a substantially thick pile of sheet material comprising;

a substantially straight torsion bar base;

two elements extendding from said commom base, one of said elements looping around the inner element to permit reversing said fastener for restoring holding forces; and a tab disposed into said fastener and secured to one of said elements for facilitating entry of the objects to be held;

said tab being an inwardly directed portion from said inner element;

said inner element being formed into means for opening said fastener; said inner element nesting within the confines of said looping element for reducing deformation of the sheet pile due to counter forces between said two elements; said torsion bar, two elements and tab of said fastener formed to lie substantially on the same plane; said two elements extending from the two opposite ends of said torsion bar base to provide maximum paper holding capacity and to provide a simple mechanism which is simple and economical to manufacture;

said looping element being longer than said inner element to provide a mounting lip;

said inner and looping elements generally being V-shaped in configuration for easily mounting and saving material costs in the manufacture of said fastener;

said tab is formed to subtantially cover the area confined within the perimeter of said inner element; said tab being detached longitudinally from straight portion which is connected to said torsion bar, but attached to said straight portion at end opposite of that connected to said torsion bar.

2. A fastener according to claim 1 wherein;

said tab, looping element and inner element are formed of the same resilient material.

3. A fastener according to claims 1 or 2 wherein;

said tab, looping element and inner element are formed of a continuous single piece of resilient material.

4. A fastener according to claims 1 or 2 wherein;

the loose ends of the inner element and the looping element extend to a location near the central axis of the torsion bar for preventing damage to the sheets being held.

* * * * *